US006397786B1

(12) United States Patent
Wu

(10) Patent No.: US 6,397,786 B1
(45) Date of Patent: Jun. 4, 2002

(54) INDIRECT DAMP GENERATOR

(76) Inventor: Chia-Hsiung Wu, P.O. Box No.6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/842,697

(22) Filed: Apr. 27, 2001

(51) Int. Cl.[7] ..... F24F 3/14; F22B 1/02

(52) U.S. Cl. ..... 122/31.2; 122/4 R; 392/447; 126/113

(58) Field of Search ..... 122/4 R, 31.1, 122/31.2, 32, 36; 392/447, 448, 451; 126/113

(56) References Cited

U.S. PATENT DOCUMENTS 4,835,366 A * 5/1989 Owen et al. ..... 219/317
5,235,161 A * 8/1993 Reusche et al. ..... 392/447
5,388,179 A * 2/1995 Boyd, Jr. et al. ..... 392/451

* cited by examiner

*Primary Examiner*—Gregory Wilson

(57) ABSTRACT

An indirect damp generator is arranged atop water to generate moisture. The indirect damp generator mainly comprises a floating carrier, a vapor generator arranged atop the floating carrier and a heatproof article with capillary function below the vapor generator and assembled to the vapor generator. The heatproof article is inserted into water to guide the water upward to the vapor generator. The vapor generator evaporates tiny droplet from water with high efficiency and does heat water on bottom of container thereof.

3 Claims, 4 Drawing Sheets

INDIRECT DAMP GENERATOR

BACKGROUND OF THE INVENTION

1. Field of the Invention

The present invention relates to an indirect damp generator, especially to an indirect damp generator absorbing water through a capillary tube and evaporating the water.

2. Description of the Prior Art

The conventional damp generator is usually used in dry area such as Frigid Zone to increase the moisture of that area. The conventional damp generator generally comprises a heater to directly boil water to generate water vapor. Alternatively, the heater of the damp generator is sunk into water and boil the water to generate water vapor. The water vapor is mixed with air to increase moisture. However, in above mentioned two approaches, the water vapor is generated by boiling, the vapor particle is large and is hard to diffuse by Brownian motion. The vapor is often condensed above the damp generator. The vapor generation rate is slow by these approaches and the conventional damp generator is dangerous for burning. Moreover, the container used contain the water has the problem of heat dissipation.

SUMMARY OF THE INVENTION

It is an object of the present invention to provide an indirect damp generator absorbing water through a capillary tube and evaporating the water. The evaporated water droplet is tiny.

It is another object of the present invention to provide an indirect damp generator, which will not heat the water on bottom of the container.

It is another object of the present invention to provide an indirect damp generator, which can also be used for face-sweating.

To achieve above object, the present invention provides an indirect damp generator arranged atop water to generate moisture; the indirect damp generator mainly comprising a floating carrier, a vapor generator arranged atop the floating carrier and a heatproof article with capillary function below the vapor generator and assembled to the vapor generator; the heatproof article inserted into water to guide the water upward to the vapor generator.

The various objects and advantages of the present invention will be more readily understood from the following detailed description when read in conjunction with the appended drawing, in which:

DETAILED DESCRIPTION OF THE INVENTION

Figure 1:
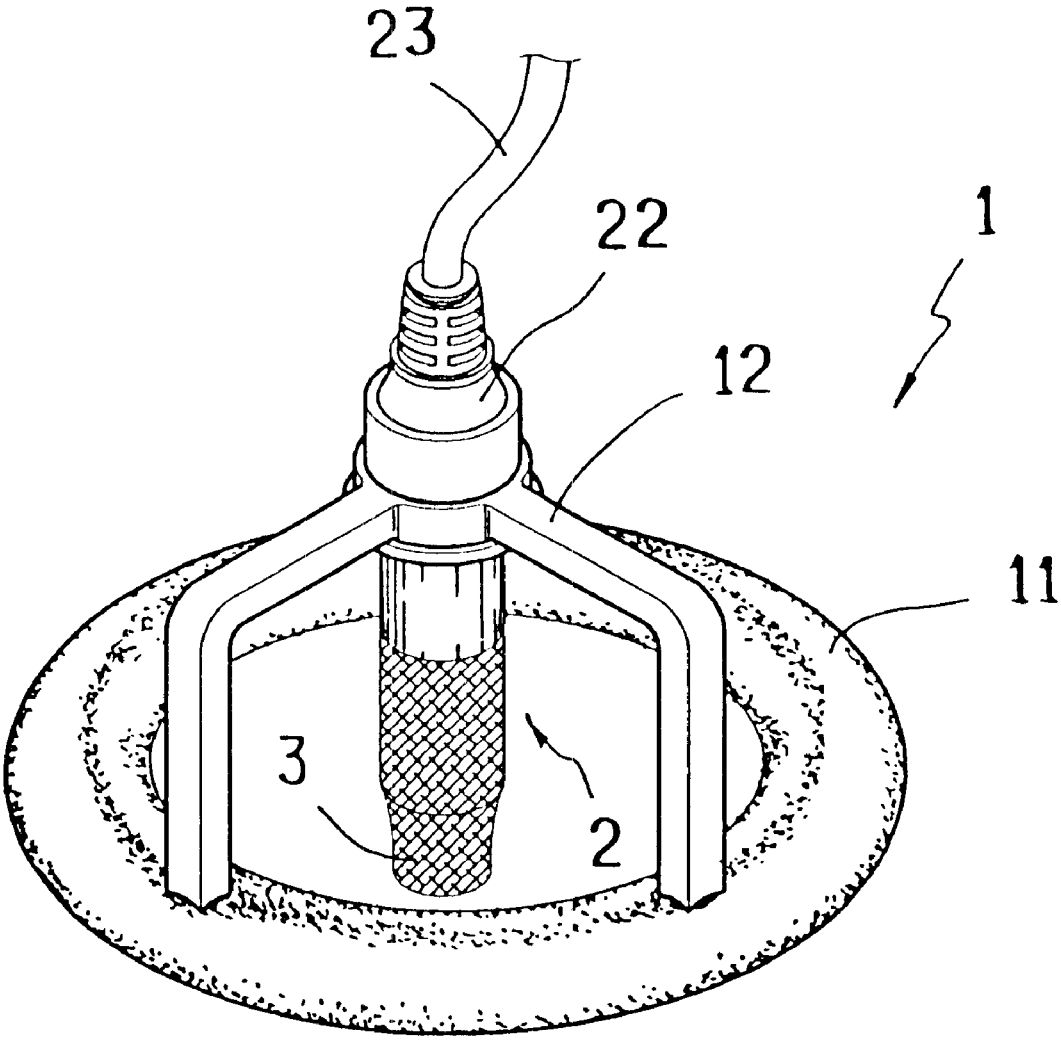
FIG. 1 shows the perspective view of the indirect damp generator of the present invention.

FIG. 1 shows the perspective view of the indirect damp generator of the present invention, which is used to directly heat the water. The indirect damp generator of the present invention mainly comprises a floating carrier 1 with a floating body 11 arranged on bottom thereof and a cylindrical vapor generator 2 mounted on a rack 12 on top of the floating body 11. The cylindrical vapor generator 2 is connected to a conductive wire 23 through a connection part 22 and has a heatproof article 3 with capillary function.

Figure 2:
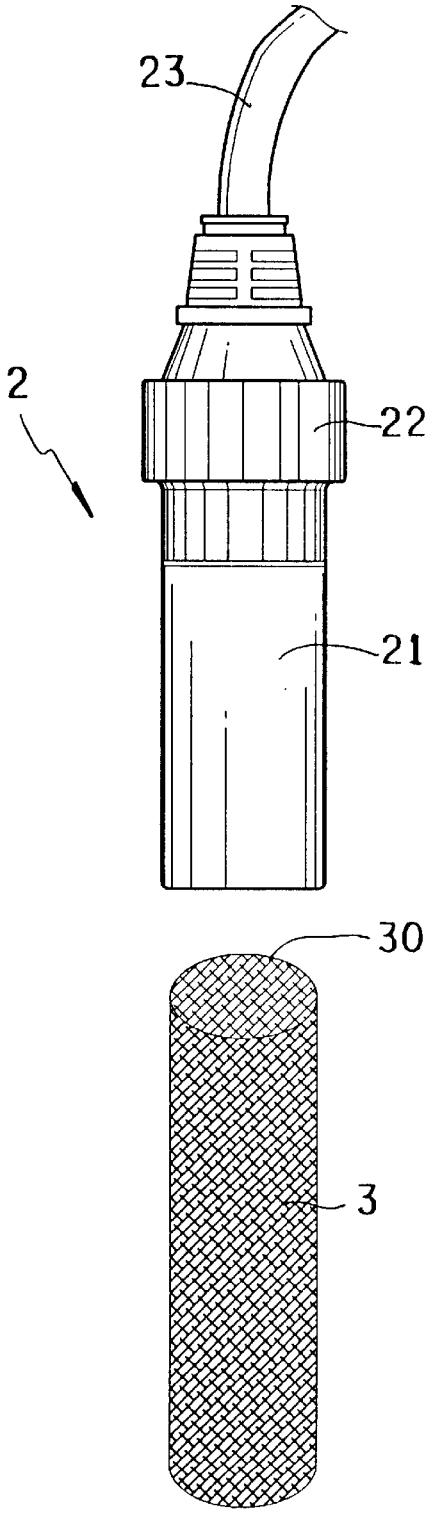
FIG. 2 shows the sectional view of the indirect damp generator of the present invention.
Figure 3:
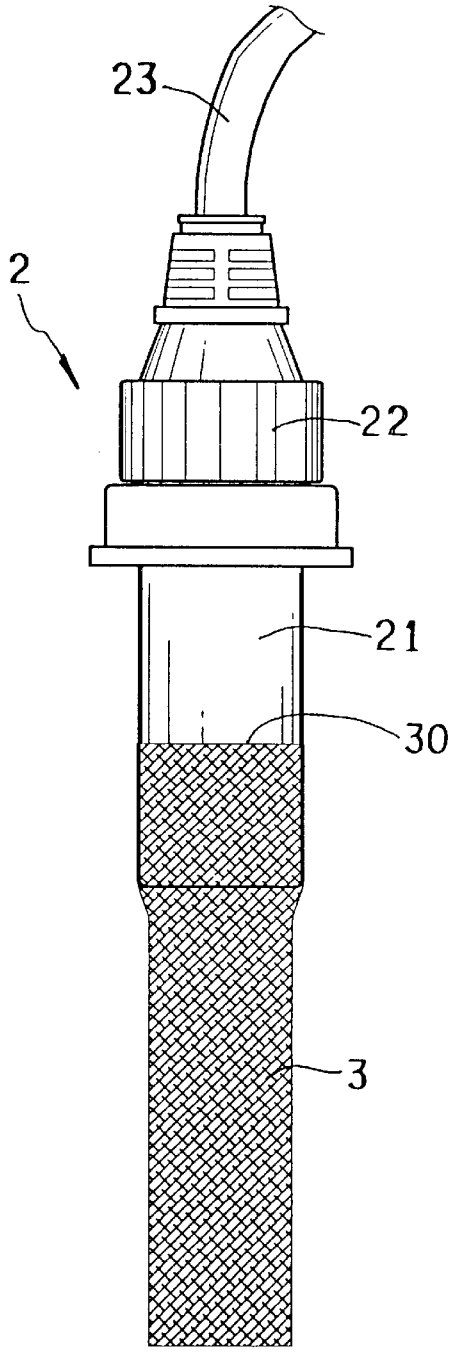
FIG. 3 shows the assembling of the indirect damp generator of the present invention.

FIG. 2 shows the sectional view of the indirect damp generator of the present invention. The heatproof article 3 is of tubular shape and the inner edge thereof is fit to the outer edge of a heater 21 of the cylindrical vapor generator 2. The heatproof article 3 has an opened upper end 30 and assembled on outer surface of the bottom of the heater 21, as shown in FIG. 3. The bottom end of the heatproof article 3 is a free end.

Figure 4:
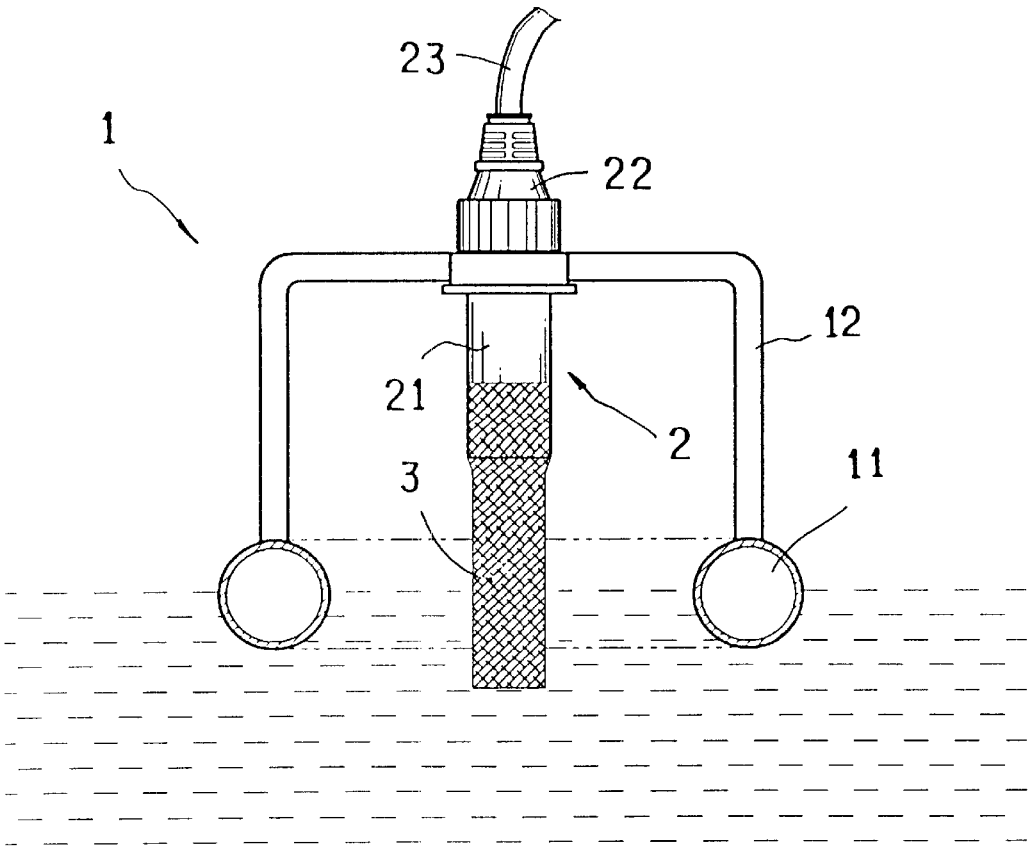
FIG. 4 demonstrates the operation of the indirect damp generator of the present invention.

FIG. 4 demonstrates the operation of the indirect damp generator of the present invention. The cylindrical vapor generator 2 is assembled on the rack 12 of the floating carrier 1. The cylindrical vapor generator 2 is kept atop the water by the floating force of the floating body 11. The heater 21 heats the tiny water droplet guided by the capillary effect of the heatproof article 3. More particularly, the heatproof article 3 guides small and specific amount of water droplet to outer surface of the heater 21. The heater 21 evaporates the water droplet to vapor. Therefore, the vapor particle thus generated has small size and the indirect damp generator of the present invention has high efficiency. The vapor particle thus generated has high mobility and is not easily condensed. Moreover, the water on the bottom of the container is not heated by the heater 21. Therefore, the indirect damp generator of the present invention can be arranged atop a fishbowl or other ornament with water. The indirect damp generator of the present invention will not influence the creatures in the container of water. Moreover, the indirect damp generator of the present invention can be equipped with a current sensor to detect the current flowing through the cylindrical vapor generator 2 to stop the cylindrical vapor generator 2 if necessary.

Figure 5:
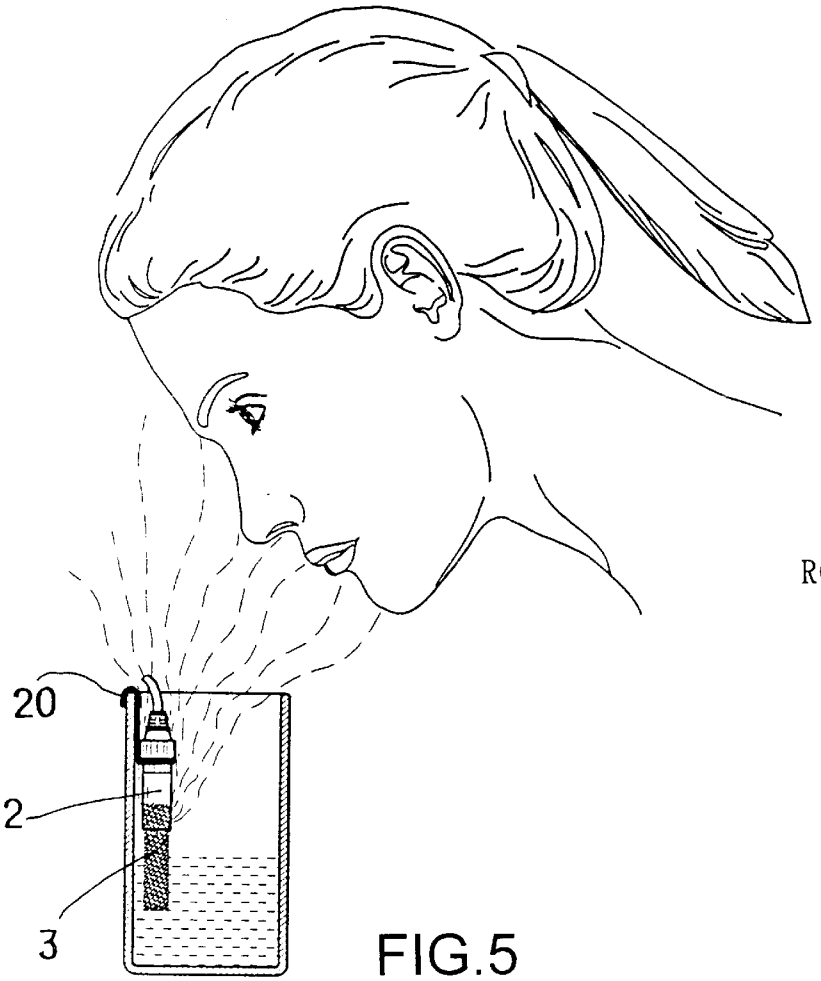
FIG. 5 shows another application of the present invention.

FIG. 5 shows another application of the present invention. The indirect damp generator according to another preferred embodiment of the present invention has not the floating body 11 and is hooked to the rim of the container by a hook 20. In this arrangement, the indirect damp generator according to another preferred embodiment of the present invention can be used to face-sweating.

Figure 6:
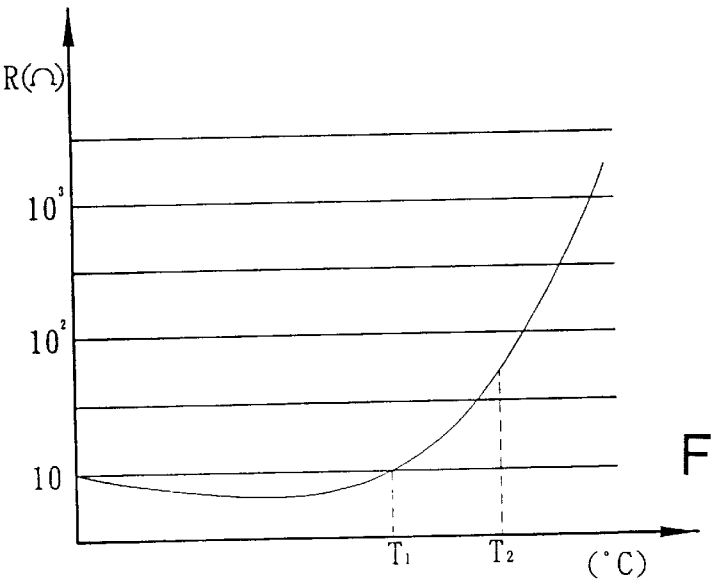
FIG. 6 shows the characteristic curve of the ceramic resistor heater with positive thermal coefficient.

With reference to FIG. 6, the cylindrical vapor generator 2 of the indirect damp generator of the present invention adopts preferably ceramic resistor heater with positive thermal coefficient. Therefore, the temperature is increased with the rise of the resistance as shown in this figure. At a first temperature t1, the resistance is 10Ω and the resistance is logarithmically raised to 100Ω as the first temperature t1 is linearly increased to a second temperature t2. Therefore, the indirect damp generator of the present invention has rapid temperature increasing effect and can keep stable temperature.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. An indirect damp generator arranged atop water to generate moisture; the indirect damp generator mainly comprising a floating carrier, a vapor generator arranged atop the floating carrier and a heatproof article with capillary function below the vapor generator and assembled to the vapor generator; the heatproof article inserted into water to guide the water upward to the vapor generator.

2. The indirect damp generator as in claim 1, wherein the vapor generator can be detached from the floating carrier.

3. The indirect damp generator as in claim 1, wherein the heatproof article is fit to the vapor generator.

* * * * *